US007543805B2

(12) United States Patent
Yoshie et al.

(10) Patent No.: US 7,543,805 B2
(45) Date of Patent: Jun. 9, 2009

(54) BOOKBINDING SYSTEM, IMAGE FORMING APPARATUS AND BOOKBINDING APPARATUS

(75) Inventors: Kohji Yoshie, Sagamihara (JP); Saburo Shimizu, Hachioji (JP); Riichi Hama, Hachioji (JP); Masahiro Kaneko, Hino (JP); Kiyoshi Hata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 210 days.

(21) Appl. No.: 11/498,067

(22) Filed: Aug. 3, 2006

(65) Prior Publication Data

US 2007/0045920 A1 Mar. 1, 2007

(30) Foreign Application Priority Data

Aug. 31, 2005 (JP) ..... 2005-251004

(51) Int. Cl.
*B65H 37/04* (2006.01)

(52) U.S. Cl. ..... 270/58.08; 270/58.01; 270/58.07; 270/37

(58) Field of Classification Search ..... 270/37, 270/58.01, 58.07, 58.08; 412/4, 19
See application file for complete search history.

(56) References Cited

U.S. PATENT DOCUMENTS

| | | | | |
|---|---|---|---|---|
| 6,354,059 | B1 * | 3/2002 | Yoshie et al. | 53/117 |
| 7,020,430 | B2 * | 3/2006 | Kudo et al. | 399/382 |
| 2003/0235446 | A1 * | 12/2003 | Kudo et al. | 399/382 |
| 2006/0120780 | A1 * | 6/2006 | Kudo et al. | 399/382 |
| 2007/0035081 | A1 * | 2/2007 | Kaneko et al. | 270/58.09 |

* cited by examiner

*Primary Examiner*—Gene Crawford
*Assistant Examiner*—Leslie A Nicholson, III
(74) *Attorney, Agent, or Firm*—Finnegan, Henderson, Farabow, Garrett & Dunner, L.L.P.

(57) ABSTRACT

A bookbinding system wherein, when additional printing is conducted on a cover sheet which has been printed thereon outside an image forming apparatus, the image forming apparatus is provided with an ejection-outlet through which the image forming apparatus accepts the cover sheet coming from a bookbinding apparatus and the cover sheet printed by a printing device of the image forming apparatus is fed out to the bookbinding apparatus for bookbinding.

5 Claims, 9 Drawing Sheets

BOOKBINDING SYSTEM, IMAGE FORMING APPARATUS AND BOOKBINDING APPARATUS

This application is based on Japanese Patent Application No. 2005-251004 filed on Aug. 31, 2005 in Japanese Patent Office, the entire content of which is hereby incorporated by reference.

BACKGROUND OF THE INVENTION

The present invention relates to a bookbinding system in which an image forming apparatus is connected with a bookbinding apparatus for performing bookbinding, and in particular, to conveyance of a cover sheet which is a sheet to be a cover.

In recent years, there are proposed bookbinding apparatuses for a stapling process employing a stapling device or a wrapping bookbinding process wherein adhesives are applied on one end face of a bundle of sheets, then, a cover sheet is pasted on the one end face and the bundle of sheets is wrapped in the cover sheet, for bookbinding, for sheets on which images are recorded by image forming apparatuses such as a copying machine, a printer and a multifunctional machine including the foregoing.

Further, there has been proposed a bookbinding apparatus wherein sheets each being to be a cover are set in a cover sheet supply section in the bookbinding apparatus, and the sheet is supplied from the cover sheet supply section to a bookbinding section in the bookbinding apparatus for bookbinding (for example, Patent Document 1).

Again, Patent Document 2 discloses a bookbinding apparatus wherein a printing device that prints on a cover sheet is provided, and a size of a character that can be printed is restricted corresponding to a thickness of a bundle of sheets.

In general, captions showing contents of a booklet are printed on a cover sheet of the booklet. However, in the case of an image forming system described in Patent Document 1, it is impossible to print on a cover sheet that is set in the cover sheet supply section. It is therefore necessary to set a cover sheet which has been printed in advance. Further, in the case of an on-line apparatus described in the Patent Document 2, a printing device needs to be provided in the bookbinding apparatus separately from an image forming apparatus, which causes a problem that an apparatus is made to be large-sized, and control is complicated.

(Patent Document 1) Unexamined Japanese Patent Application Publication No. 2004-209869

(Patent Document 2) Unexamined Japanese Patent Application Publication No. HEI 8-85275

SUMMARY

The present inventions are as follows.

(1) A bookbinding system conducting bookbinding through connection of an image forming apparatus and a bookbinding apparatus, wherein the image forming apparatus is constructed so that a cover sheet supplied from a cover-sheet supply section of the bookbinding apparatus is accepted, and a cover sheet is fed out to the bookbinding apparatus after images are recorded on the cover sheet by an image recording device in the image forming apparatus, and the bookbinding apparatus conducts bookbinding process on sheets accepted from the image forming apparatus and the cover sheet.

(2) An image forming apparatus on which a bookbinding apparatus can be mounted, wherein a cover sheet supplied from a cover-sheet supply section of the bookbinding apparatus is accepted, and the cover sheet is fed out to the bookbinding apparatus after an image has been recorded on the cover sheet by an image recording device in the image forming apparatus.

(3) A bookbinding apparatus on which an image forming apparatus can be mounted, wherein the bookbinding apparatus ejects a cover sheet from a cover-sheet supply section to the image forming apparatus, and the bookbinding apparatus accepts the cover sheet on which an images has been recorded by an image recording device in the image forming apparatus, and then conducts bookbinding for the cover sheet and the sheets accepted from the image forming apparatus.

DETAILED DESCRIPTION OF THE PREFERRED EMBODIMENT

Figure 1:
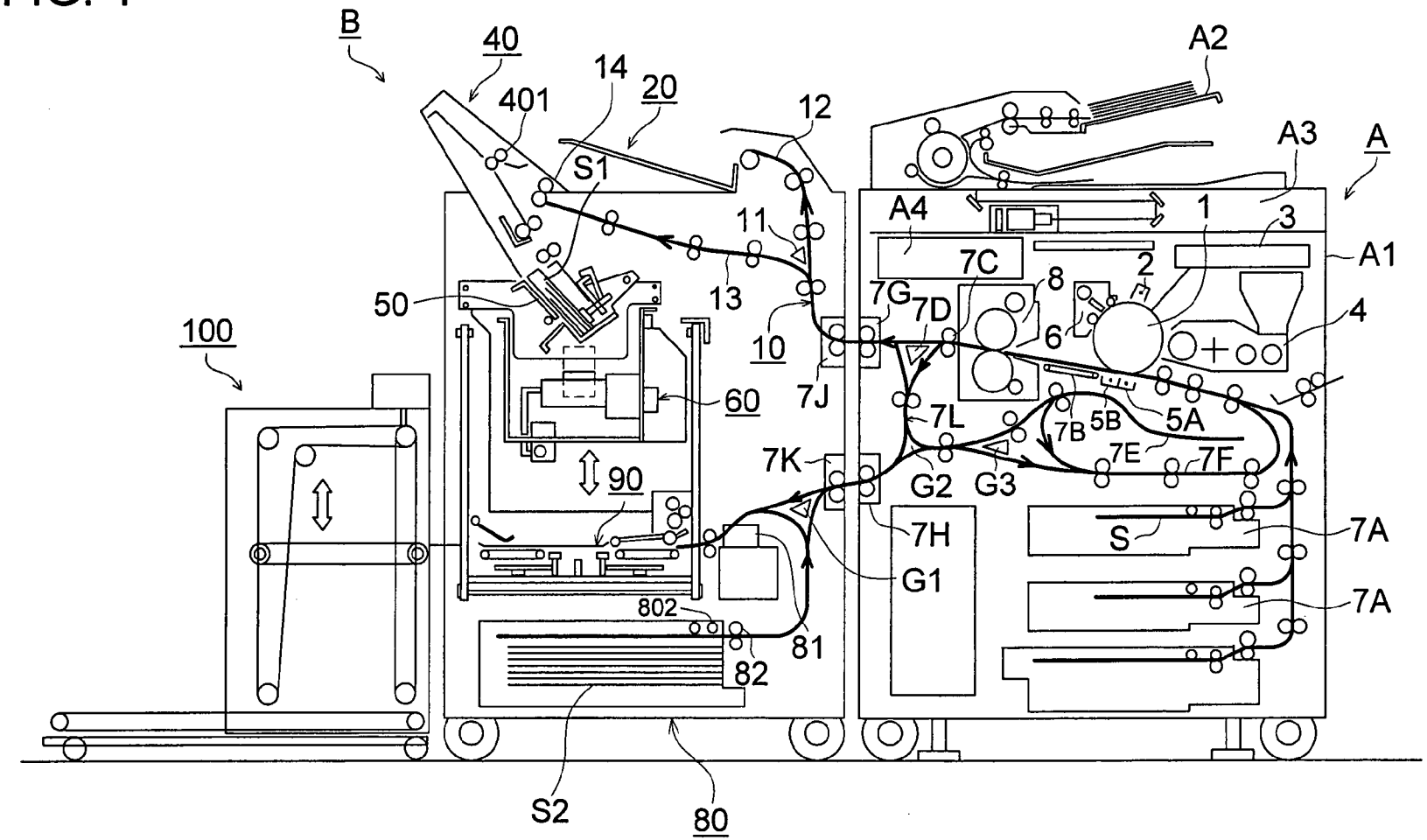
FIG. 1 is a front view of a bookbinding apparatus relating to an embodiment of the invention.

Next, a bookbinding apparatus, an image forming apparatus and a bookbinding system of the invention will be explained as follows, referring to the drawings.

<Image Forming Apparatus A>

FIG. 1 is an entire structure diagram of a bookbinding system equipped with an image forming apparatus A and a bookbinding apparatus B.

Image forming apparatus A has an image recording device in which charging unit 2, image exposure unit 3, developing unit 4, transfer unit 5A, neutralizing unit 5B and cleaning unit 6 are arranged around rotary image carrier 1. In the image recording device, exposure scanning based on image data obtained from a document through reading by a laser beam of the image exposure unit 3 is conducted after a surface of the image carrier 1 is charged evenly by the charging unit 2, to form a latent image, and the latent image is developed reversely by the developing unit 4, and a toner image is formed on a surface of the image carrier 1. The image data can be image information made in and received from image data generating device such as a personal computer PC as an exterior apparatus.

Further, in the following descriptions, the constitutive sheets are denoted by sheet S1, the bundle of sheets composed of plural sheets S1 is denoted by sheet bundle Sa, the sheet for the cover is denoted by cover sheet S2, and the booklet formed by joining the bundle of sheets Sa and the cover sheet is denoted by book S3. In addition, the cover sheet S2 may be indicated as the cover sheet S2A on which images have been printed by the image forming apparatus, while distinguishing it from the cover sheet S2B which is the cover sheet that is stored inside the bookbinding apparatus.

Sheet S1 fed from sheet-storing section 7 is sent to a transfer position, where the aforesaid toner image is transferred onto the sheet S1 by transfer unit 5A. After that, electric charges on the reverse side of the sheet S1 are eliminated by neutralizing unit 5B, and the sheet S1 is separated from image carrier 1, then, is conveyed by conveyance section 7B, and is heated to be fixed successively by fixing unit 8. Then, the sheet S1 ejected out of sheet-ejection roller 7C is conveyed to the first ejection-outlet 7G with transportation path changeover plate 7D to be sent out to the bookbinding apparatus.

When forming images on both sides of sheet S1, sheet S1 subjected to heating and fixing by fixing unit 8 is diverted from an ordinary sheet ejection path by transportation path changeover plate 7D, then, is reversed upside down through a movement in a form of a switchback in reversing transportation section 7E, and passes the image forming section again so that an image is formed on the back of sheet S1. Sheet S1 passes through fixing unit 8, sheet ejection rollers 7C and the first ejection-outlet 7G and is fed into bookbinding apparatus.

The document feeder A2 conveys the document one sheet at a time to the reading position. The image reading section A3 reads out the images in the document that has been transported by the document feeder A2 or in the document placed on the document table, and generates image signals. The communication section A4 carries out communication with the network equipment, and generates the image signals as the image information upon receiving the image formation command transmitted from the network.

With respect to the surface of image carrier 1 after image processing, developing agents remaining on the surface are removed by cleaning unit 6 so that the image carrier 1 turns out to be ready for the succeeding image forming.

Further, image forming apparatus A receives cover sheet S2B conveyed from cover-sheet storing section 80 of bookbinding apparatus B to be described later, and records images on the cover sheet S2B with an image recording device in the image forming apparatus, and then, ejects the cover sheet S2B again to bookbinding apparatus B through second ejection-outlet 7H which is provided on the image forming apparatus A.

Next, as an example, a bookbinding system of the invention will be explained based on bookbinding apparatus B that employs an adhesive (which is called paste) for bookbinding, to which, however, the invention is not limited.

(Bookbinding Apparatus B)

Bookbinding apparatus B has a sheet conveyance path in which sheet S1 ejected out of the first ejection-outlet 7G of the image forming apparatus A is fed through the first accepting inlet 7J and ejected to sheet-ejection tray 20 through ejection section 12, or conveyed to sheet-reversing section 40 where the sheet is caused to switchback due to the selection of switching gate 11 provided in the middle of conveyance section 10.

Further, the bookbinding apparatus B has therein accumulating section 50 that accumulates sheet S1 fed in one by one from sheet reversing section 40 after being conveyed to the sheet reversing section 40 when bookbinding is specified on an operation section, coating unit 60, cover-sheet storing section 80 that stores cover sheet S2B, sheet-feeding rollers 802 that feed the cover sheet S2B, cutter 81 representing a cutting device that cuts cover sheet S2 to the length corresponding to a bundle of sheets S1, cover-sheet supporting section 90 that supports the cover sheet and book-ejection section 100 where a book whose cover sheet and sheets are joined is stacked.

When bookbinding is specified on the operation section, the sheet S1 is ejected to the sheet-ejection tray 20.

Next, a cover sheet conveyance path of the invention will be explained.

<Cover-Sheet Conveyance Path>

In FIG. 1, thick lines indicate a conveyance path for cover sheets or sheets, and an arrow in the middle of the path shows the direction of travel at its point.

A cover sheet S2B stored in the cover-sheet storing section 80 is fed by the sheet-feeding rollers 802, then, is conveyed to the second ejection-outlet 7H of the image forming apparatus A through second accepting inlet 7K at the switching gate G1. The cover sheet S2B is advanced to reversing conveyance section 7E by switching gate G3 through switching gate G2, or to be advanced to conveyance section 7F as it is.

A cover sheet S2B to be stored in the cover-sheet storing section 80 may also be a cover sheet which has already been subjected to printing by another printer and is to be subjected to additional printing by the present system, in addition to a cover sheet on which nothing has been printed. If the additional image is printed on the same surface as that for the cover sheet S2B (printing on the outer side of the cover sheet), the cover sheet is reversed by the reversing conveyance section 7E to advance to the conveyance section 7F. When the additional image is printed on the reverse surface of the cover sheet S2B, the cover sheet advances to the conveyance section 7F as it is, without passing through the reversing conveyance section 7E.

A cover sheet S2 conveyed by the conveyance section 7F passes through an image forming section where an image to be printed additionally is formed thereon, then, the cover sheet passes through fixing unit 8, and advances to the cover-sheet conveyance section 7L through conveyance path switching plate 7D.

A cover sheet printing mode will be explained as follows, referring to FIGS. 8 and 9. In the meantime, arrow lines shown with fine lines indicate a flow of conveyance of cover sheet S2A after printing (described as S2A because the cover sheet has been printed).

In cover sheet printing mode 1, an additionally printed surface becomes the outer side of the cover sheet, and a cover sheet is printed each time one bundle of sheets Sa is made, to create book S3.

In cover sheet printing mode 2, an additionally printed surface becomes the outer side of the cover sheet, and a plurality of cover sheets are printed and stored in a cover-sheet storing section.

In cover sheet printing mode 3, an additionally printed surface becomes the inner side of the cover sheet, and a cover sheet is printed each time one bundle of sheets Sa is made, to create book S3.

In cover sheet printing mode 4, an additionally printed surface becomes the inner side of the cover sheet, and a plurality of cover sheets are printed and stored in a cover-sheet storing section.

Figure 8:
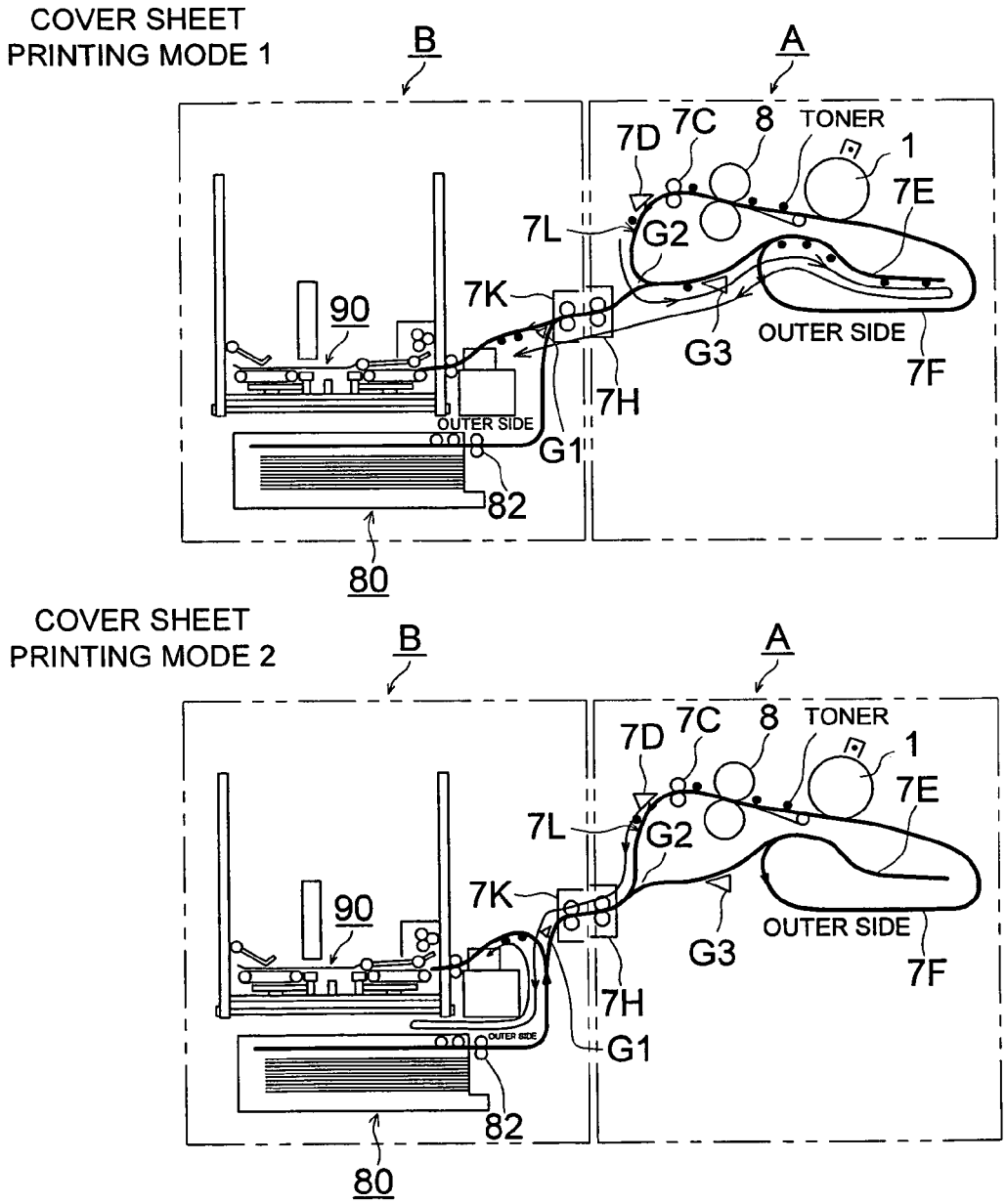
FIG. 8 is a schematic diagram showing the cover sheet printing mode 1 and the cover sheet printing mode 2.

FIG. 8 is a schematic diagram showing cover sheet printing mode 1 and cover sheet printing mode 2.

In the case of cover sheet printing mode 1, cover sheet S2A which has advanced to cover-sheet conveyance section 7L through the conveyance path switching plate 7D. The cover sheet S2A further passes through switching gates G2 and G3 to advance to reversing conveyance section 7E to be reversed, and is advanced by the switching gates G2 and G3 to the second ejection-outlet 7H.

The cover sheet S2A ejected from the second ejection-outlet 7H passes through the second accepting inlet 7K, and is conveyed to the cover-sheet supporting section 90 by the switching gate G1.

In the case of cover sheet printing mode 2, cover sheet S2A which has advanced to cover-sheet conveyance section 7L through the conveyance path switching plate 7D is advanced to the second ejection-outlet 7H by the switching gates G2.

The cover sheet S2A ejected from the second ejection-outlet 7H passes through the second accepting inlet 7K, and is conveyed by the switching gates G1, to the cover-sheet storing section 80, where the cover sheet switchbacks to be conveyed to the cover-sheet supporting section 90.

Figure 9:
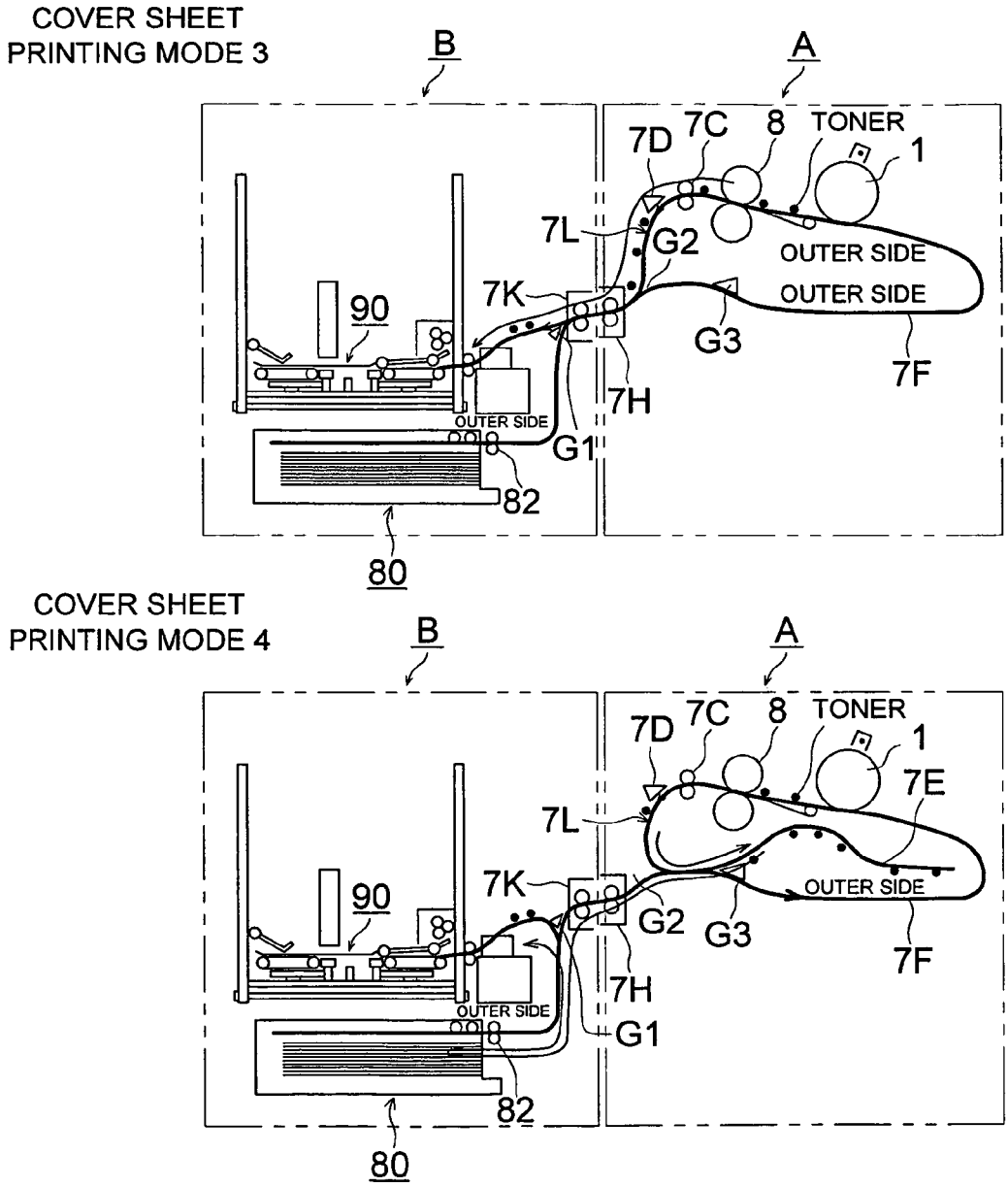
FIG. 9 is a schematic diagram showing the cover sheet printing mode 3 and the cover sheet printing mode 4.

FIG. 9 is a schematic diagram showing cover sheet printing mode 3 and cover sheet printing mode 4.

In the case of cover sheet printing mode 3, cover sheet S2A which has advanced to cover-sheet conveyance section 7L through the conveyance path switching plate 7D is advanced to the second ejection-outlet 7H by the switching gates G2.

The cover sheet S2A ejected from the second ejection-outlet 7H passes through the second accepting inlet 7K, and is conveyed by the switching gates G1, to the cover-sheet supporting section 90.

In the case of cover sheet printing mode 4, cover sheet S2A which has advanced to cover-sheet conveyance section 7L through the conveyance path switching plate 7D. The sheet S2A passes through switching gates G2 and G3 to advance to reversing conveyance section 7E to be reversed, and is advanced by the switching gates G2 and G3 to the second ejection-outlet 7H.

The cover sheet S2A ejected from the second ejection-outlet 7H passes through the second accepting inlet 7K, and is conveyed by the switching gates G1, to the cover-sheet storing section 80, where the cover sheet switchbacks to be conveyed to the cover-sheet supporting section 90.

For four types of cover sheet printing mode, there are provided a first ejection-outlet that ejects sheets to a bookbinding apparatus and a second ejection-outlet that ejects cover sheets, and the first ejection-outlet makes it possible to eject a sheet carrying an image, while, the second ejection-outlet makes it possible to accept a cover sheet into an image forming apparatus, and to eject the accepted cover sheet. Thus, it is possible to create book S3 in the bookbinding apparatus, after printing images on the cover sheet by the use of a printing device of the image forming apparatus.

<Respective Sections of Bookbinding Apparatus>

Respective sections of the bookbinding apparatus will be explained.

Figure 2:
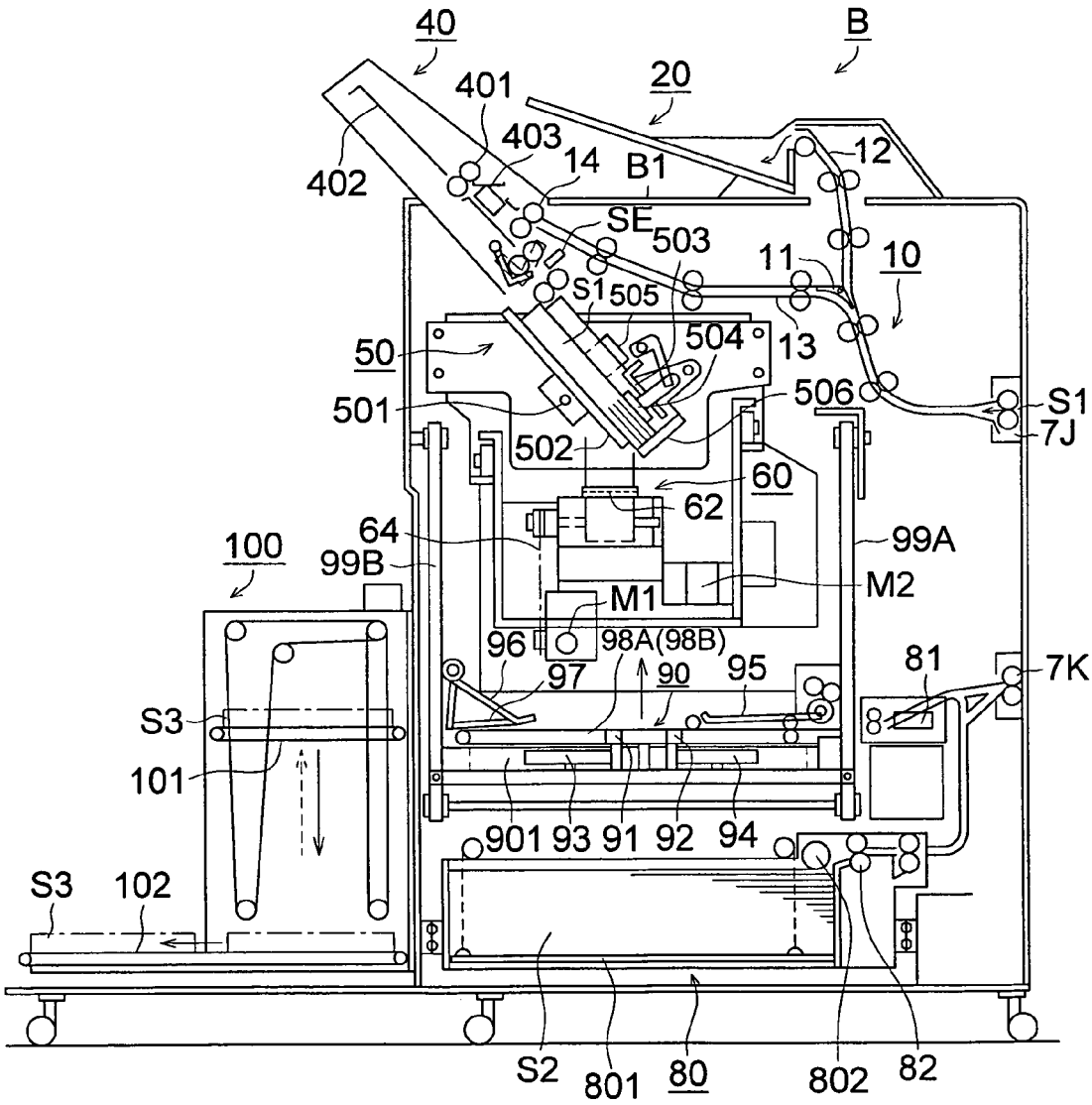
FIG. 2 is a cross sectional view of a bookbinding apparatus.

FIG. 2 is a schematic cross sectional view of bookbinding apparatus B.

Sheet S1 conveyed through conveyance path 13 is ejected by sheet-ejection roller 14, then, is conveyed by swinging pressure rollers 401 to rise along inclined reversing tray 402. After that, the swinging pressure rollers 401 are rotated inversely to convey the sheet S1 downward. The sheet S1 conveyed downward falls on accumulating section 50 to be stacked thereon.

The sheet S1 that has descended along the sheet-reversing section 40 is supported to be inclined at the accumulating section 50 by a sheet supporting device that is composed of supporting plate 502 and stopper plate 506.

Sheets S1 ejected from the image forming apparatus one by one are stacked on the accumulating section 50, whereby, a bundle of sheets S1 is formed. The number of sheets S1 forming a bundle is grasped by the number of documents counted by the use of an automatic document feeder mounted on the image forming apparatus, the number of documents obtained from document image information transmitted through a personal computer or the like, and the number of documents inputted by an operator in advance.

The numeral 504 represents a member to hold lifting of stacked sheets S1, and it separates and touches each time one sheet S1 is supplied to the accumulating section 50 to hold sheet S1. The numeral 505 represents an aligning plate that aligns side edges of sheets.

When the preset number of sheets S1 are stacked on the accumulating section 50, holding plate 503 operates to hold a bundle of sheets S1.

Under the condition that the bundle of sheets S1 is interposed and held, the accumulating section 50 swivels around shaft 501 to change a posture of the bundle of sheets S1 from the inclined state to the vertical state.

Coating Process

Figure 3:
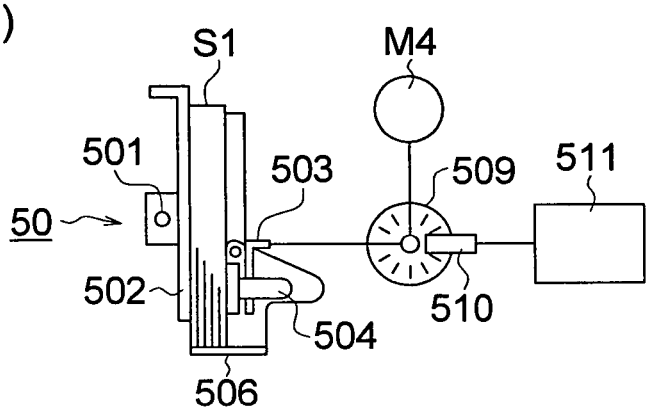
FIG. 3 is a diagram showing a coating process of adhesive.
Figure 3:
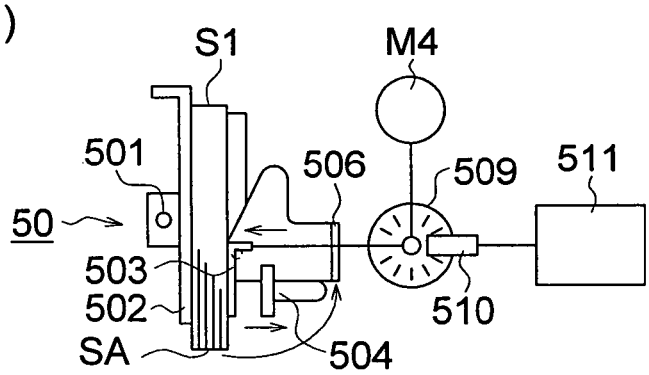
Figure 3:
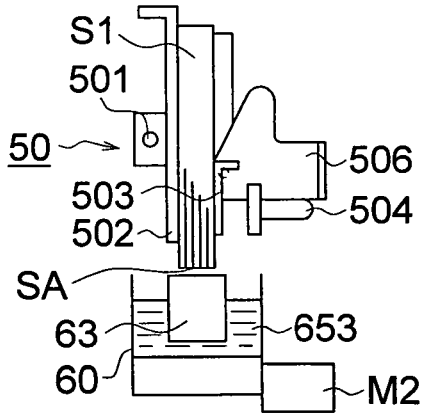
Figure 3:
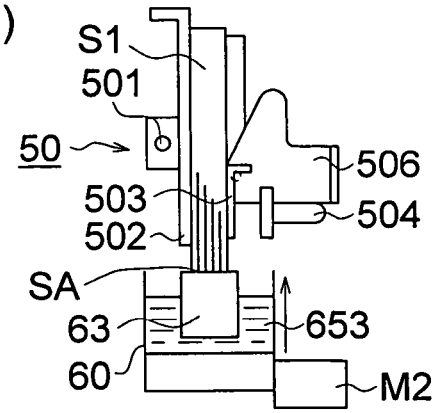

FIG. 3 shows a process for coating paste, while holding the bundle of sheets S1 to be in the vertical state.

Before showing the coating process, how sheets are held by the holding plate 503 will be explained, referring to FIG. 3 (*a*).

Holding plate 503 is driven by motor M4 to move and thereby to press a bundle of sheets S1, and then, it stops when detecting that the driving torque for pressing reaches a prescribed value. Thus, a bundle of sheets S1 is held firmly by supporting plate 502 and holding plate 503. A stop position of the holding plate 503 is detected by encoder 509 and is stored in a memory of position detecting device 511.

Under the condition that the bundle of sheets S1 is held, the stopper 506 rotates by 90° to retreat as shown in FIG. 3 (*b*).

Under the condition shown in FIG. 3 (*c*), bottom surface SA of the bundle of sheets S1 is away from coating roller 63.

Next, as shown in FIG. 3 (*d*), coating unit 60 housing therein hot melt adhesive 653 rises until the coating roller 63 touches the bottom surface of a bundle of sheets S1 in the drawing, and the coating roller 63 moves in the direction perpendicular to the page surface in FIG. 3 to coat adhesives 653 on the bottom surface SA of the bundle of sheets S1.

Coating process will be explained next, referring to FIG. 4.

Figure 4:
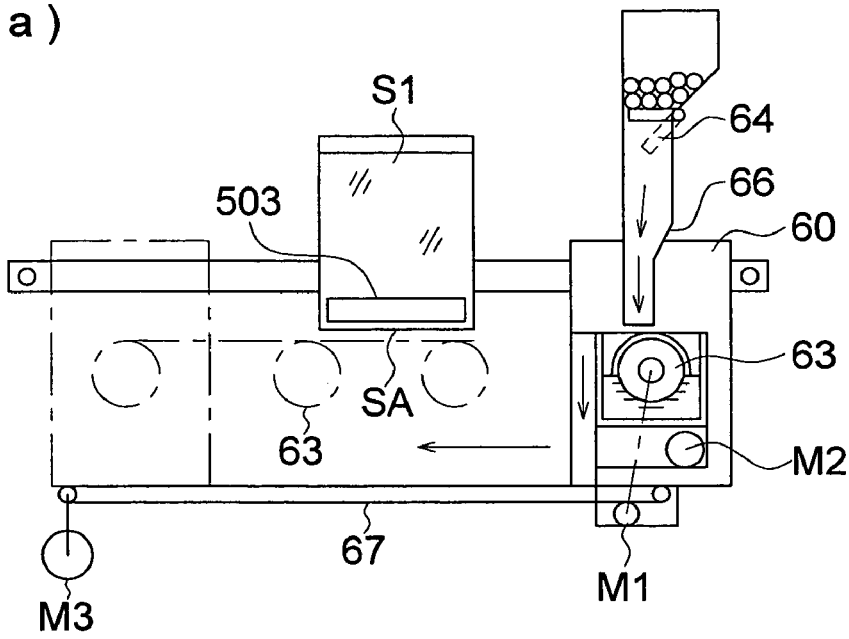
FIG. 4 is a diagram showing a movement of a coating head.
Figure 4:
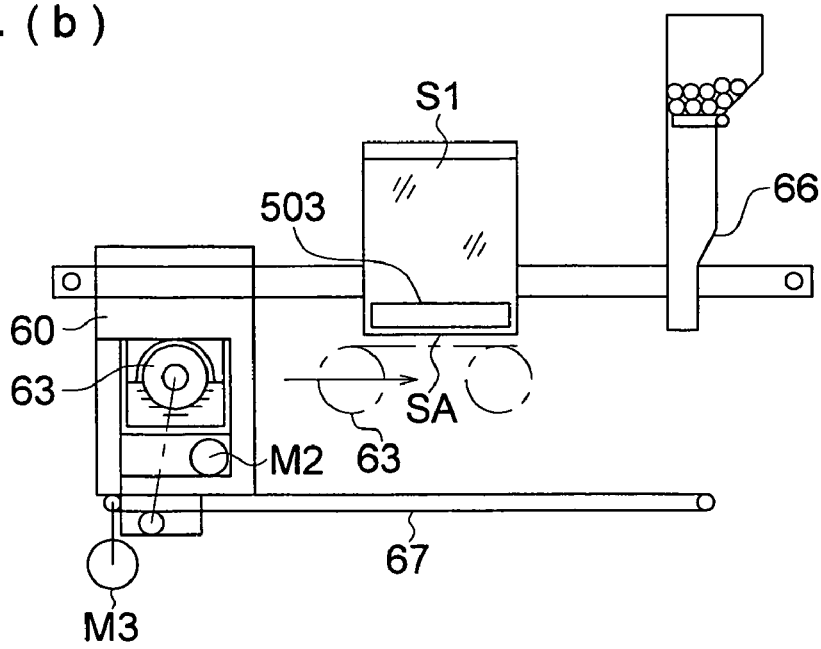

At a stage of the start of bookbinding, the coating unit 60 is at the rightmost position (first position) representing a home position in FIG. 4 (*a*). At the home position, solid adhesives are supplied to the coating unit 60 through supply path 66, when inside cover 64 is opened. Solid adhesives thus supplied are heated and melted in the coating unit 60. At the start of the bookbinding process, the coating unit 60 moves from the home position toward the left side, and this movement from the home position to the leftmost position (second position) is carried out by belt 67 (second moving device) that is driven by motor M3.

The movement is carried out based on signals which are resulted when sheet sensor SE provided immediately at the downstream side of reversing tray 402 (see FIG. 2) detects a passage of a leading edge of the last sheet S1 among sheets S1 stacked on the accumulating section 50.

During the course of the movement of the coating unit 60 to the leftmost position, coating roller 63 is away from the bottom surface of a bundle of sheets S1.

During the stage of movement of the coating unit 60 from the leftmost position toward the rightmost position in FIG. 4 (*b*), the coating roller 63 is driven by motor M2 to rise, and comes in contact with the bottom surface of the sheets S1 to coat adhesives 653. With respect to the start of the coating process in FIG. 4 (*b*), timing control is carried out so that the coating may be started after waiting a stop of conveyance for a cover sheet that has been cut by cutter 81, when a bundle of sheets S1 is set to be in the vertical state which makes it possible to coat.

Owing to this timing control, operations of respective sections are carried out continuously, and the bookbinding process is conducted at high efficiency accordingly. Joining of cover sheet S2 is performed after the coating unit 60 has moved to its home position.

Joining Process

Next, the joining process of a bundle of sheets S1 and cover sheet S2 together will be explained as follows, referring to FIGS. 5-7.

Figure 5:
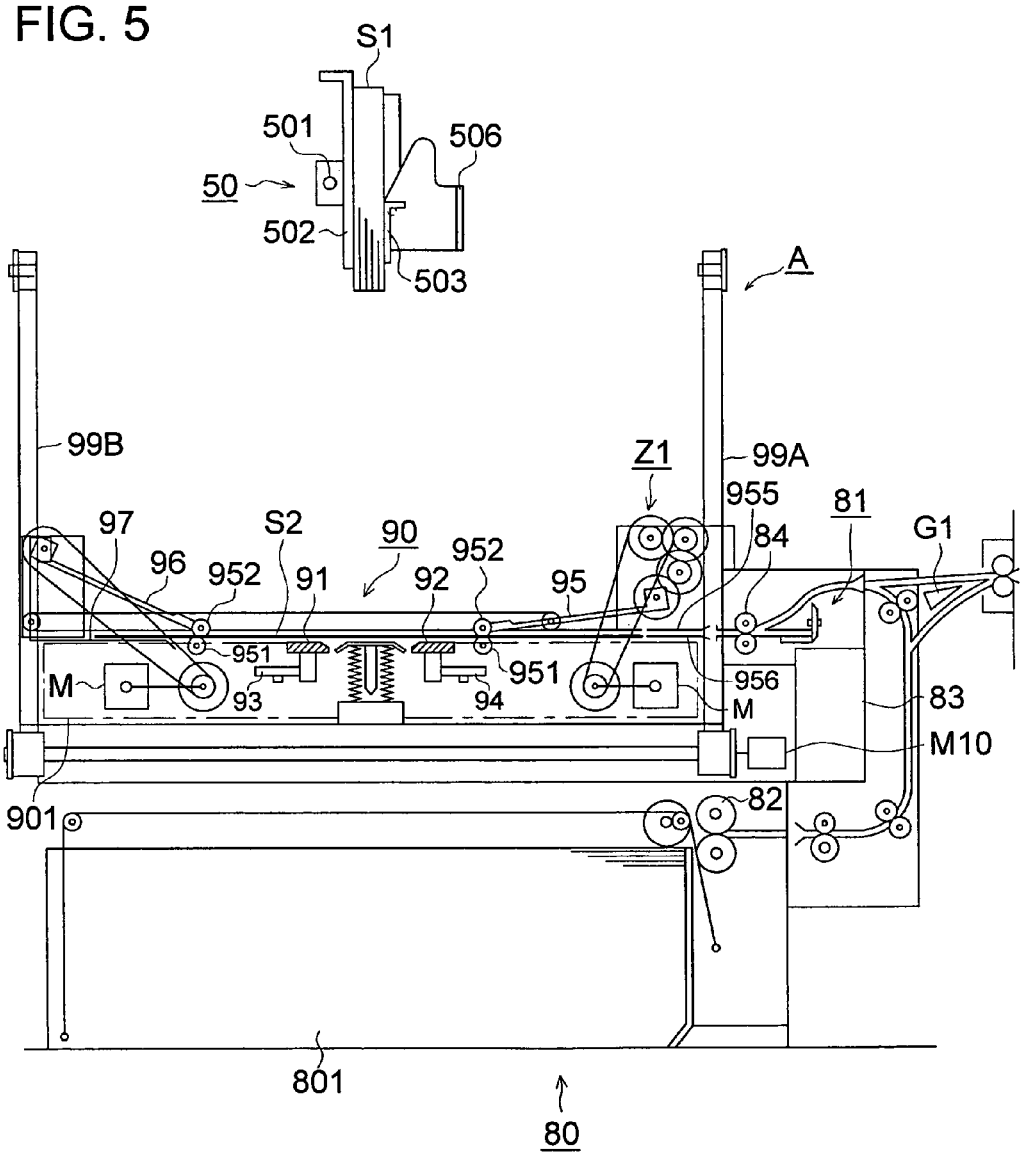
FIG. 5 is a diagram showing a process for joining a cover sheet with book constitutive sheets.

FIG. 5 is a schematic sectional view of cover-sheet supporting section 90 that supports the cover sheet.

Regarding the cover sheet S2, there are two occasions. In one occasion, cover sheet S2A which has been subjected to additional printing by image forming apparatus A is ejected from the second ejection-outlet 7H as stated earlier. The cover sheet S2A is supplied to bookbinding apparatus B through second accepting inlet 7K, to be stored in the cover-sheet supporting section 90 through conveyance path switching gate G1. In the other occasion, cover sheet S2B is stored in sheet feeding tray 801 of cover-sheet storing section 80 that is provided at the lower part of the bookbinding apparatus as shown in FIG. 2.

When using the sheet which has already been printed as a cover sheet, or when a cover sheet is needed without printing, if the cover sheet S2B is sent directly to cover-sheet supporting section 90 without passing through image forming apparatus A from the cover-sheet storing section 80, it is possible to shorten more the time required for completion of bookbinding and to improve productivity more than using cover sheet S2A ejected from the image forming apparatus, which is an advantage.

The cover sheets S2B and S2A conveyed from the sheet feeding tray 801 to the cover-sheet supporting section 90 by conveyance rollers 82 are aligned at the cover-sheet supporting section 90. Then, they switchback to be cut to the length corresponding to the bundle of sheets S1 by cutter 81 representing a cutting device, and conveyed by conveyance rollers 84 to be placed horizontally on cover-sheet supporting unit 901 shown with one-dot chain lines. The cover-sheet supporting unit 901 is composed of pressing members 91 and 92 and of plural members such as cams 93 and 94 that drive respectively the pressing members 91 and 92.

The cutter 81 cuts cover sheet S2 to the length based on information of a size of the cover sheet S2, information of a size of the sheets S1 and on information of a thickness of a bundle of sheets S1 stored in position detecting device 511. Chips produced from the cover sheet S2 are collected in collection box 83.

Figure 6:
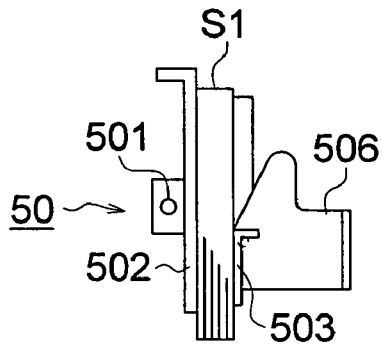
FIG. 6 is a diagram showing a returning process after joining a cover sheet with book constitutive sheets.
Figure 6:
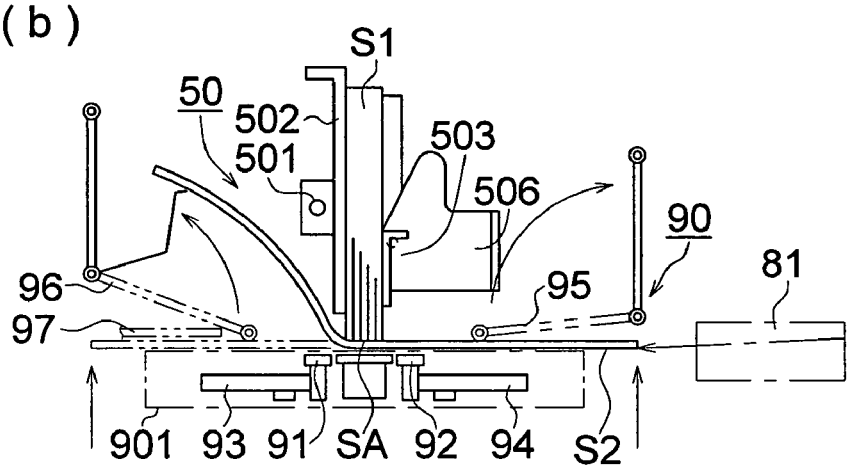
Figure 6:
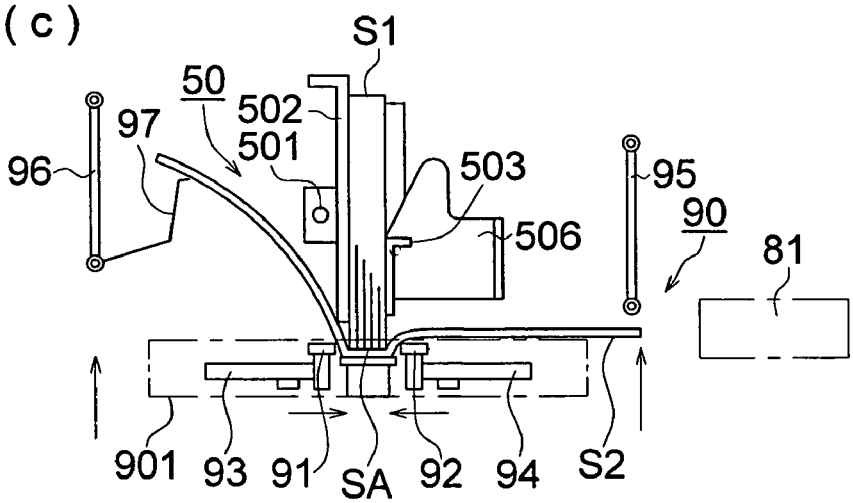

A joining process for a book is shown in FIG. 6.

FIG. 6 (*a*) is a diagram showing how a bundle of sheets S1 is held by supporting plate 502 and holding plate 503. FIG. 6 (*b*) is a diagram showing the state wherein cover-sheet supporting unit 901 rises and touches a bundle of sheets. FIG. 6 (*c*) is a diagram showing the state wherein the cover-sheet supporting unit 901 rises further by several millimeters from the state shown in FIG. 6 (*b*). In the state shown in FIG. 6 (*c*), pressing members 91 and 92 press the cover sheet S2 from both sides after the cover-sheet supporting unit rises to give a corner to a boundary between a spine and an front cover sheet and to give a corner to a boundary between a spine and a back cover sheet, and the cover sheet S2 is caused to stick closely to sheets S1, thus, book S3 is formed. A period of time for the pressing members 91 and 92 to keep pressing is about 5 sec., and pressing force is about 200 Nf.

Devices to move the pressing members 91 and 92 in the horizontal directions are cams 93 and 94 driven by a motor (not shown). Meanwhile, the pressing members 91 and 92 may also be moved by the structure wherein a rack is provided on each pressing member, and a pinion engaging with the rack rotates to move the rack.

Figure 7:
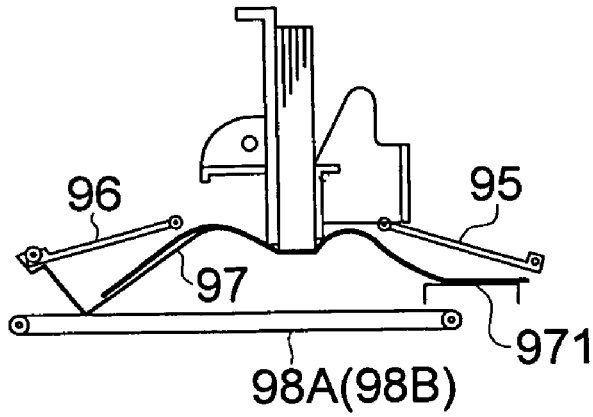
FIG. 7 is a diagram illustrating a process on a cover sheet after joining.
Figure 7:
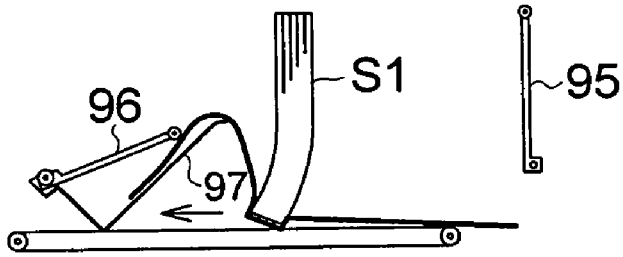
Figure 7:
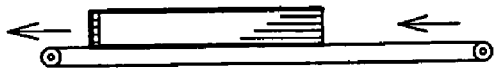

FIG. 7 is a diagram showing handling of cover sheet S2 after completion of joining of cover sheet S2, and a period of time up to the moment when book S3 is conveyed to book-ejection section 100.

FIG. 7 (*a*) shows that cover-sheet supporting unit 901 is driven by belts 99A and 99B to descend, and cover-sheet holding members 95, 96 and 97 are lifted to prevent buckling by supporting both ends of the cover sheet S2 to prevent them from hanging down, and further, cover-sheet lifting plate 971 is lifted. When the holding plate 503 moves to its retreated position in the aforesaid state, pressing is canceled. Due to this, book S3 composed of a bundle of sheets S1 and cover sheet S2 falls on belts 98A and 98B (FIG. 7 (*b*)). Belts 98A and 98B are rotated while the cover-sheet supporting unit 901 is caused to descend again, to lay down the book S3 while sending it toward book-ejection section 100. In this case, cover-sheet holding members 96 and 97 are rotated toward the rising direction greatly, to lift the cover sheet on the left side. As shown in FIG. 7 (*c*), the book S3 is sent by the belts 98A and 98B to the leftmost end, and is ejected to the book-ejection section 100 as it stands.

What is claimed is:

1. A bookbinding system comprising:

an image forming apparatus including an image recording device; and a bookbinding apparatus including a cover-sheet supply section which supplies a cover sheet, wherein the image forming apparatus and the bookbinding apparatus are connected for conducting bookbinding the image forming apparatus further comprising:

a first ejection-outlet through which a sheet on which an image is recorded by the image recording device is ejected to the bookbinding apparatus;

a second ejection-outlet through which the cover sheet is ejected and can be received into the image forming apparatus;

a first conveyance path which feeds the sheet to the first ejection-outlet; and a second conveyance path which feeds the cover sheet to the second ejection-outlet, the bookbinding apparatus further comprising:

a first accepting inlet connected to the first ejection-outlet; and a second accepting inlet connected to the second ejection-outlet, wherein the image forming apparatus receives the cover sheet supplied from the cover-sheet supply section through the second ejection-outlet and can feed the cover sheet to the bookbinding apparatus through the second conveyance path and the second ejection-outlet after recording the image on the cover sheet with the image recording device and the bookbinding apparatus conducts bookbinding for the sheet received from the image forming apparatus and the cover sheet.

2. The bookbinding system of claim 1, wherein the image forming apparatus comprises a reversing conveyance path for reversing the sheet and the cover sheet.

3. The bookbinding system of claim 1, wherein the bookbinding apparatus feeds the cover sheet received from the image forming apparatus to the cover-sheet supply section.

4. An image forming apparatus on which a bookbinding apparatus can be mounted, the image forming apparatus comprising:

an image recording device;

a first ejection-outlet through which a sheet on which an image is recorded by the image recording device is ejected;

a second ejection-outlet through which a cover sheet is ejected and can be received into the image forming apparatus;

a first conveyance path which feeds the sheet to the first ejection-outlet; and a second conveyance path which feeds the cover sheet to the second ejection-outlet, wherein the image forming apparatus receives the cover sheet supplied through the second ejection-outlet and feeds out the cover sheet through the second conveyance path and the second ejection-outlet after recording the image on the cover sheet with the image recording device.

5. The image toning apparatus of claim 4, comprising a reversing conveyance path for reversing the cover sheet.

* * * * *